US010354777B2

(12) United States Patent
Varkey et al.

(10) Patent No.: US 10,354,777 B2
(45) Date of Patent: Jul. 16, 2019

(54) ELECTRICAL CONDUCTORS AND PROCESSES FOR MAKING AND USING SAME

(71) Applicant: Schlumberger Technology Corporaton, Sugar Land, TX (US)

(72) Inventors: Joseph Varkey, Sugar Land, TX (US); Willem Albert Wijnberg, Houston, TX (US); Maria Auxiliadora Grisanti, Missouri City, TX (US); Burcu Unal Altintas, Richmond, TX (US); Montie Wayne Morrison, Richmond, TX (US); Qingdi Huang, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 15/711,550

(22) Filed: Sep. 21, 2017

(65) Prior Publication Data

US 2019/0088386 A1 Mar. 21, 2019

(51) Int. Cl.
*H01B 13/06* (2006.01)
*H01B 7/02* (2006.01)
(Continued)

(52) U.S. Cl.
CPC ..... *H01B 7/0216* (2013.01); *H01B 7/0009* (2013.01); *H01B 13/0013* (2013.01);
(Continued)

(58) Field of Classification Search
CPC ... H01B 7/0216; H01B 13/0016; H01B 13/06
(Continued)

(56) References Cited

U.S. PATENT DOCUMENTS 1,370,731 A * 3/1921 Chase ..... H01B 7/26 156/55
3,441,660 A * 4/1969 Garner ..... H01B 7/221 174/102 SC (Continued)

FOREIGN PATENT DOCUMENTS

| | | |
|---|---|---|
| CN | 203085259 U | 7/2013 |
| WO | 2016022687 A1 | 2/2016 |
| WO | 2017074357 A1 | 5/2017 |

OTHER PUBLICATIONS

International Search Report and Written Opinion issued in the related PCT application PCT/US2018/052122, dated Jan. 11, 2019 (14 pages).

*Primary Examiner* — Andargie M Aychillhum
*Assistant Examiner* — Michael F McAllister
(74) *Attorney, Agent, or Firm* — Eileen Pape

(57) ABSTRACT

Electrical conductors and processes for making and using same. In some examples, the electrical conductors can include an inner electrically conductive element, which can define a central longitudinal axis. A first polymer layer can be disposed circumferentially about the inner electrically conductive element. A plurality of electrical conductor segments can be disposed about the first polymer layer and spaced around the central longitudinal axis. A second polymer layer can be disposed between the electrical conductor segments. The second polymer layer and the electrical conductor segments together can define a substantially annular cross-sectional area and an outer perimeter surface. An electrical insulator can be disposed about the outer perimeter surface defined by the second polymer layer and the electrical conductor segments.

11 Claims, 9 Drawing Sheets

(51) Int. Cl.
*H01B 13/00* (2006.01)
*H01B 7/00* (2006.01)
*H01B 7/04* (2006.01)

(52) U.S. Cl.
CPC ..... *H01B 13/0016* (2013.01); *H01B 13/06* (2013.01); *H01B 7/045* (2013.01)

(58) Field of Classification Search
USPC ..... 174/116
See application file for complete search history.

(56) References Cited

U.S. PATENT DOCUMENTS

| | | | | |
|---|---|---|---|---|
| 3,586,751 | A * | 6/1971 | Schoerner | B22D 11/0602 174/113 R |
| 4,550,559 | A * | 11/1985 | Thomson | B29C 48/30 57/223 |
| 4,745,238 | A * | 5/1988 | Kotthaus | H01B 7/12 138/111 |
| 5,569,876 | A * | 10/1996 | Podgorski | H01B 7/0233 174/137 R |
| 7,696,430 | B2 * | 4/2010 | Santos Lopez | H01B 9/006 174/110 R |
| 9,627,100 | B2 | 4/2017 | Pourladian et al. | |
| 2008/0031578 | A1 * | 2/2008 | Varkey | E21B 47/123 385/100 |
| 2009/0139744 | A1 * | 6/2009 | Varkey | H01B 7/046 174/113 R |
| 2014/0041925 | A1 | 2/2014 | Davis et al. | |
| 2016/0343475 | A1 | 11/2016 | Hirao et al. | |

* cited by examiner

ELECTRICAL CONDUCTORS AND PROCESSES FOR MAKING AND USING SAME

BACKGROUND

Field

Embodiments described generally relate to electrical cables and processes for making and using same.

Description of the Related Art

Electrical cables for carrying electrical current can have single or multiple strand conductors. Single strand conductors can provide more conductor material per cross-sectional area than multi-strand conductors. Single strand conductors, however, tend to experience metal fatigue when used in a cable that is subjected to repeated bending. Multi-strand conductors are less subject to metal fatigue than single strand conductors of a given overall cross-sectional diameter. Multi-strand conductors, however, include less conductor material per cross-sectional area than single strand conductors and have interstitial space between the strands. The interstitial space reduces the overall cross-sectional area of conductive material in the multi-strand conductor relative to a single solid conductor of the same overall diameter. The interstitial space can also allow fluid to flow between the conductive strands.

There is a need, therefore, for improved multi-strand conductors having reduced or eliminated interstitial space.

SUMMARY

An electrical conductor according to one or more embodiments can include an inner electrically conductive element defining a central longitudinal axis. A first polymer layer can be disposed circumferentially about the inner electrically conductive element; and a plurality of electrical conductor segments can be disposed about the first polymer layer and spaced around the central longitudinal axis. A second polymer layer can be disposed between the electrical conductor segments, wherein the second polymer and the electrical conductor segments together define a substantially annular cross-sectional area and an outer perimeter surface. Furthermore, an electrical insulator can be disposed about the outer perimeter surface defined by the second polymer and the electrical conductor segments.

A process for making a conductor according to one or more embodiments can include coating an inner electrical conductive element with a first polymer material. The method can also include drawing an electrical conductor material into a plurality of electrically conductive segments each electrical conductor segment having a substantially block arc cross-sectional area, and annealing the electrically conductive segments. The method can also include spacing the electrically conductive segments about the coated inner electrically conductive element. In addition, the method can include extending a second polymer material between the electrical conductor segments such that the second polymer material and the electrical conductor segments together define a substantially annular cross-sectional area having an outer perimeter. The method can also include coating the outer perimeter of the second polymer material and electrical conductor segments with a first electrical insulator material.

Another process for making a conductor according to one or more embodiments can include coating an inner electrical conductive element with a first polymer material. The process can also include drawing an electrical conductor material into a plurality of electrical conductor segments each electrical conductor segment having a substantially block arc cross-sectional area, and annealing the electrical conductor segments. The process can also include coating the electrical conductor segments with a second polymer material. The process can further include spacing the coated electrical conductor segments about the coated inner electrical conductive segment.

DETAILED DESCRIPTION

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

Figure 1:
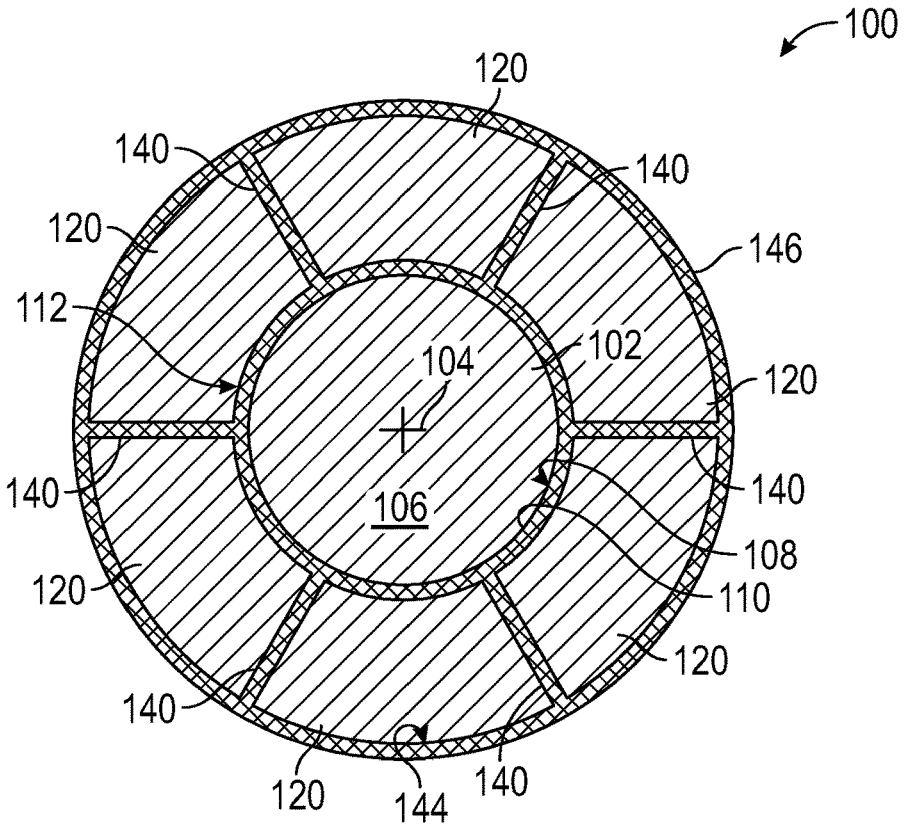
FIG. 1 depicts an end view of an illustrative electrical conductor, according to one or more embodiments described.

FIG. 1 depicts an end view of an illustrative electrical conductor 100, according to one or more embodiments. The electrical conductor 100 can include an inner electrical conductive element 102 that can define a central longitudinal axis, represented by a cross 104. The central longitudinal axis 104 can extend down a length of the electrical conductor 100 and can extend perpendicular to the cross-sectional view of the electrical conductor 100 as shown in FIG. 1. The inner electrically conductive element 102 can include one or more strands (one is shown) of an electrically conductive material and the inner electrically conductive element 102 can include a cross-sectional area 106. In some examples, the cross-sectional area 106 can be at least partially elliptically shaped, e.g., at least partially circularly shaped and/or substantially circularly shaped. The inner electrically conductive element 102 can define an outer perimeter 108 extending around an outer surface 110 of the inner electrically conductive element 102. The inner electrically conductive element 102 can define the outer perimeter 108 regardless of the shape of the cross-sectional area 106 or the number of strands making up the inner electrically conductive element 102. The electrical conductor 100 can also include a first polymer jacket 112, a plurality of electrical conductor segments 120, a second polymer jacket 140, and a first electrical insulator 146. The electrical insulator 146 can be disposed about the outer perimeter surface 144 along the length of the electrical conductor 100.

Figure 2:
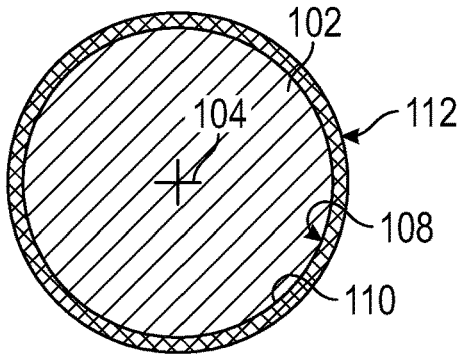
FIG. 2 depicts an end view of a circular inner electrically conductive element of the electrical conductor shown in FIG. 1, according to one or more embodiments described.

FIG. 2 depicts an end view of the inner electrically conductive element 102 of the electrical conductor 100 shown in FIG. 1, according to one or more embodiments. The first polymer jacket 112 can be disposed about the inner electrically conductive element 102 on the outer surface 110. In one or more examples, including examples in which the inner electrically conductive element 102 includes multiple strands (not shown), the first polymer jacket 112 can completely fill at least a portion of any interstitial space between strands.

Figure 3:
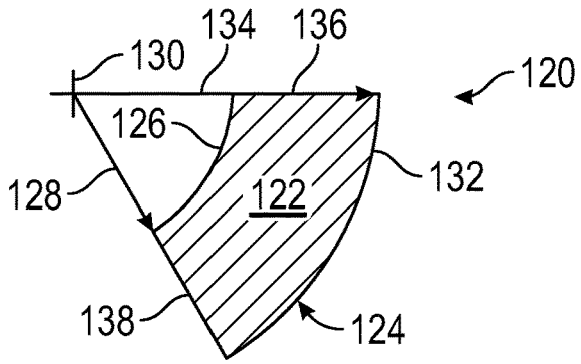
FIG. 3 depicts an end view of an electrically conductive outer segment of the electrical conductor shown in FIG. 1, according to one or more embodiments described.

FIG. 3 depicts an end view of one of the electrical electrically conductive segments 120 of the electrical conductor 100 shown in FIG. 1, according to one or more embodiments. In some examples, the electrically conductive segments 120 can have a cross-sectional area 122 that is at least partially block arc shaped. The block arc shaped cross-sectional area 122 of the electrically conductive segments 120 can include a portion of an annular shape such that two or more electrically conductive segments 120 together can at least partially form an annular shaped cross-sectional area 122 (FIG. 1). The electrically conductive segments 120 can have an outer perimeter surface 124 that can include a first arc surface 126, a second arc surface 132, a first radially extending surface 136, and a second radially extending surface 138. The first arc surface 126 can be defined by a first radius 128 extending from a segment longitudinal axis 130, the second arc surface 132 can be defined by a second radius 134 extending from the segment longitudinal axis 130. The first radially extending surface 136 can extend between the first arc surface 126 and the second arc surface 132, and can extend in a first azimuthal direction relative to the segment longitudinal axis 130. The second radially extending surface 138 can extend between the first arc surface 126 and the second arc surface 132, and can extend in a second azimuthal direction relative to the segment longitudinal axis 130.

Figure 4:
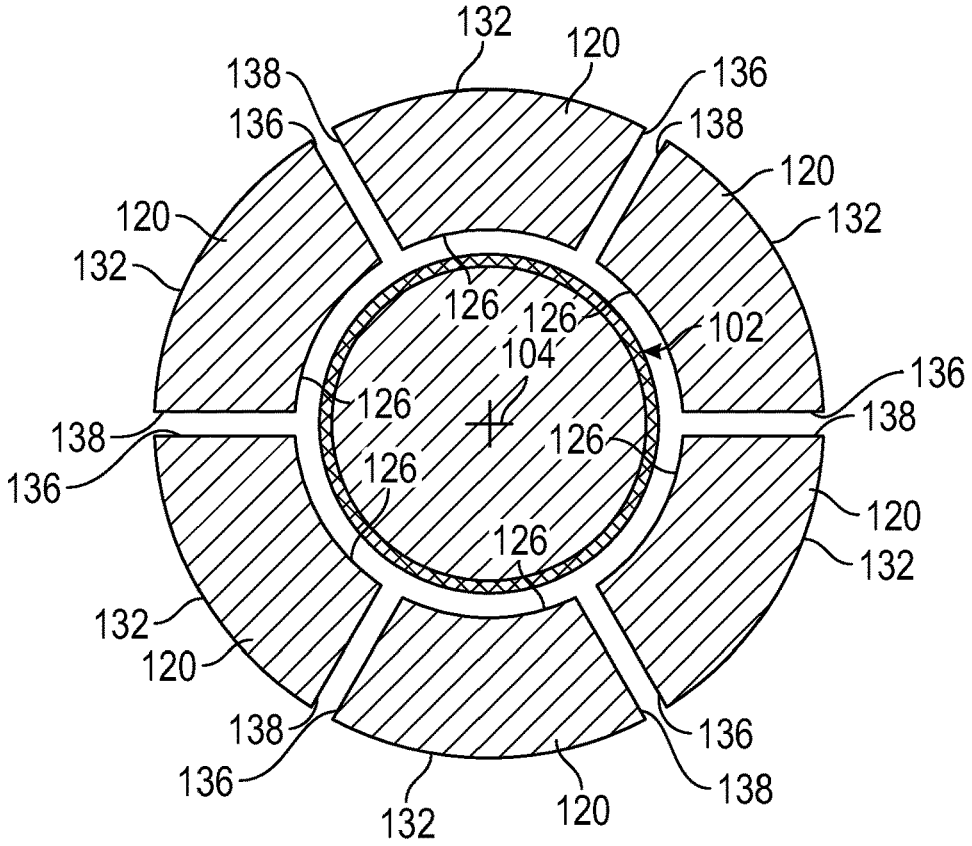
FIG. 4 depicts an end view of a plurality of the electrical conductor segments shown in FIG. 3 arranged around the inner electrically conductive element shown in FIG. 2, according to one or more embodiments described.
Figure 5:
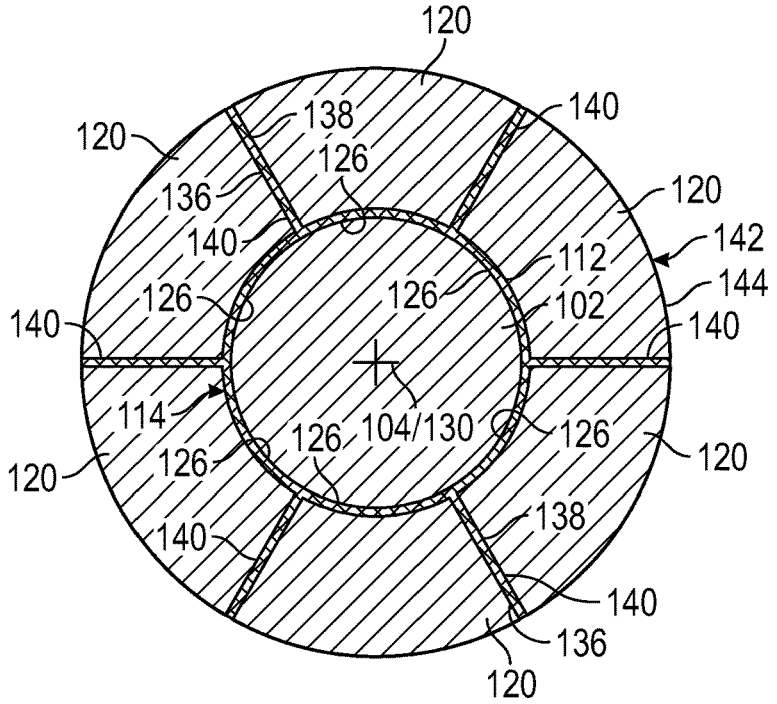
FIG. 5 depicts an end view of the electrical conductor segments shown in FIG. 4 disposed about the polymer jacket of the inner electrically conductive element shown in FIG. 2, according to one or more embodiments described.

FIG. 4 depicts an end view of a plurality of the electrically conductive segments 120 shown in FIG. 3 arranged around the inner electrically conductive element 102 shown in FIG. 2, according to one or more embodiments. The electrically conductive segments 120 (six are shown) are shown azimuthally spaced around the inner electrically conductive element 102 and radially spaced apart from the inner electrically conductive element 102. In the configuration shown in FIG. 4, the electrically conductive segments 120 have yet to be assembled into the final arrangement found in conductor 100. FIG. 5 depicts an end view of the electrical conductor segments 120 shown in FIG. 4 disposed about the first electrical insulator 112 of the inner electrical conductor 102 shown in FIG. 2, according to one or more embodiments. The configuration shown in FIG. 5 includes the electrically conductive segments 120 assembled into the final arrangement found in conductor 100 (FIG. 1). As shown in FIG. 5, the first arc surfaces 126 of the electrically conductive segments 120 can be in contact with an outer surface 114 of the first polymer jacket 112. The electrically conductive segments 120 can be azimuthally spaced from one another such that the radially extending surfaces 136/138 of one electrically conductive segment 120 can be free from contact with the radially extending surfaces 136/138 of the other electrically conductive segments 120. When the conductor 100 is assembled, the segment longitudinal axis 130 (FIG. 3) of the electrically conductive segments 120 can be co-linear with the central longitudinal axis 104 of the inner electrically conductive element 102.

The electrical conductor 100 can include the second polymer jacket 140 that can be positioned between the radially extending surfaces 136/138 of the electrically conductive segments 120. The second polymer jacket 140 can physically separate the electrically conductive segments 120 from one another and can azimuthally space the electrically conductive segments 120 from one another. The second polymer jacket 140 and the electrically conductive segments 120 can define an annular cross-sectional area 142 and an outer perimeter surface 144 along the length of the electrical conductor 100 (FIG. 1). The electrical insulator 146 can be disposed about the outer perimeter surface 144 along the length of the electrical conductor 100, as shown in FIG. 1.

Figure 6:
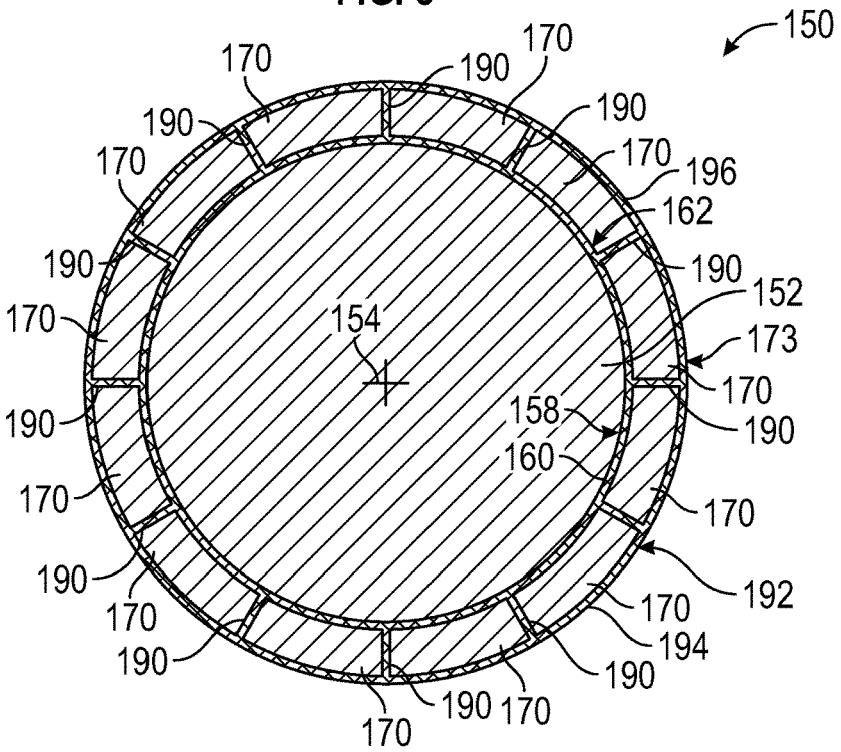
FIG. 6 depicts an end view of another illustrative electrical conductor, according to one or more embodiments described.

FIG. 6 depicts an end view of another illustrative electrical conductor 150, according to one or more embodiments. The electrical conductor 150 can include an inner electrically conductive element 152 that can define a central longitudinal axis, represented by a cross 154. The central longitudinal axis 154 can extend down a length of the electrical conductor 150 and can extend perpendicular to the cross-sectional view of the electrical conductor 150 as shown in FIG. 6. The inner electrically conductive element 152 can include one or more strands (one is shown) of an electrically conductive material and the inner electrically conductive element 152 can include a cross-sectional area 156. In some examples, the cross-sectional area 156 can be at least partially elliptically shaped, e.g., at least partially circularly shaped and/or substantially circular shaped. The inner electrically conductive element 152 can define an outer perimeter 158 extending around an outer surface 160 of the inner electrically conductive element 152. The inner electrically conductive element 152 can define the outer perimeter 158 regardless of the shape of the cross-sectional area 156 or the number of strands making up the inner electrically conductive element 152. The electrical conductor 150 can include a first polymer jacket 162, a plurality of electrical conductor segments 170, a second polymer jacket 190, and an electrical insulator 196.

Figure 7:
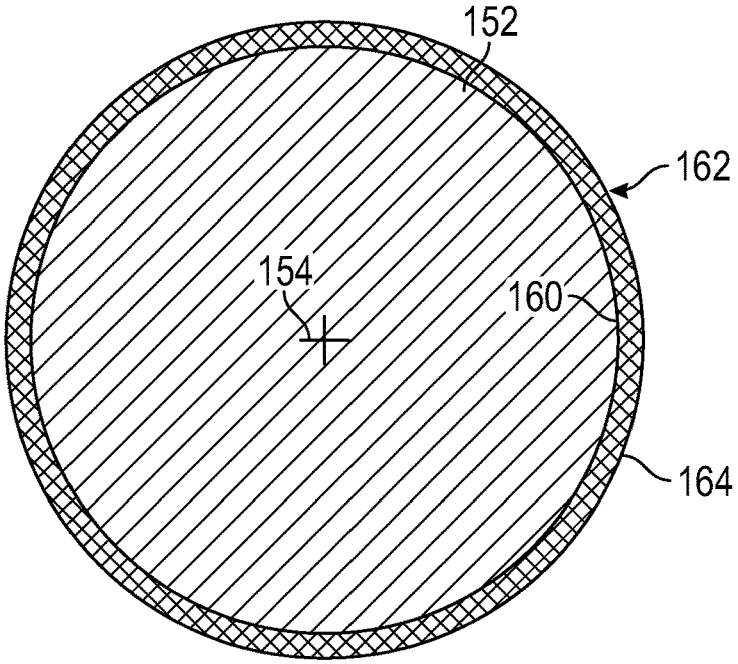
FIG. 7 depicts an end view of an inner electrically conductive element of the electrical conductor shown in FIG. 6, according to one or more embodiments described.

FIG. 7 depicts an end view of the inner electrically conductive element 152 of the electrical conductor 150 shown in FIG. 6, according to one or more embodiments. The first polymer jacket 162 can be disposed circumferentially about the inner electrically conductive element 152 on the outer surface 160. The first polymer jacket 162 can define an outer surface 164 of the first polymer jacket 162. In one or more examples, including examples in which the inner electrically conductive element 152 includes multiple strands (not shown), the first polymer jacket 162 can completely fill at least a portion of any interstitial space between strands. The inner electrically conductive elements 102/152 can have cross-sectional areas 106/156 relative to the cross-sectional areas 122/173 of the electrical conductor segments 120/170 that are larger, smaller or the same.

Figure 8:
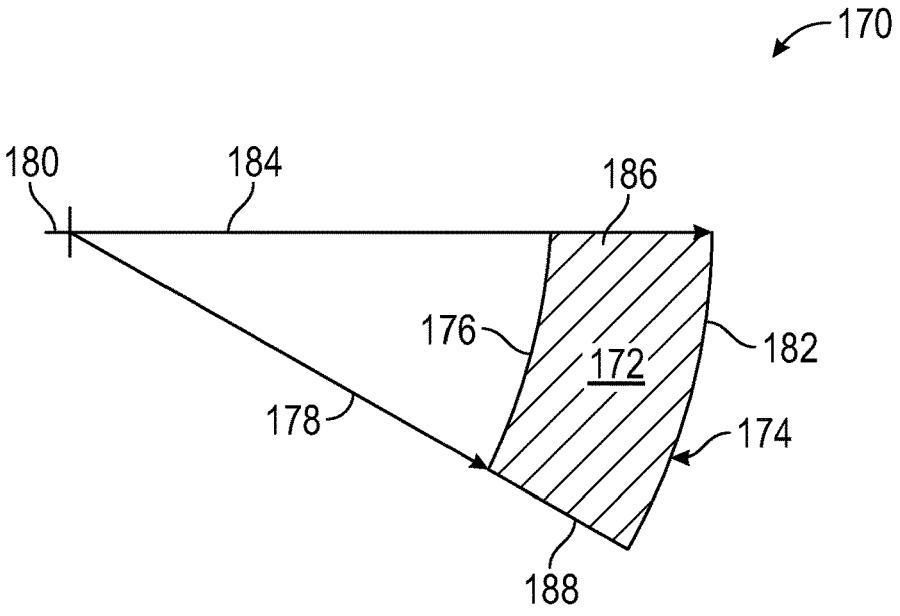
FIG. 8 depicts an end view of an outer electrical conductor segment of the electrical conductor shown in FIG. 6, according to one or more embodiments described.

FIG. 8 depicts an end view of one of the electrical conductor segments 170 of the electrical conductor 150 shown in FIG. 1, according to one or more embodiments. The electrically conductive segment 170 can have a cross-sectional area 172 that is at least partially block arc shaped. The block arc shaped cross-sectional area 172 of the electrically conductive segment 170 can include a portion of an annular shape such that two or more electrical conductor segments 170 together can at least partially form an annular shaped cross-sectional area 172 (FIG. 6). The electrically conductive segment 170 can have an outer perimeter surface 174 that can include a first arc surface 176, a second arc surface 182, a first radially extending surface 186, and a second radially extending surface 188. The first arc surface 176 can be defined by a first radius 178 extending from a segment longitudinal axis 180 and the second arc surface 182 can be defined by a second radius 184 extending from the segment longitudinal axis 180. The first radially extending surface 186 can extend between the first arc surface 176 and the second arc surface 182, and can extend in a first azimuthal direction relative to the segment longitudinal axis 180. The second radially extending surface 188 can extend between the first arc surface 176 and the second arc surface 182, and can extend in a second azimuthal direction relative to the segment longitudinal axis 180.

Figure 9:
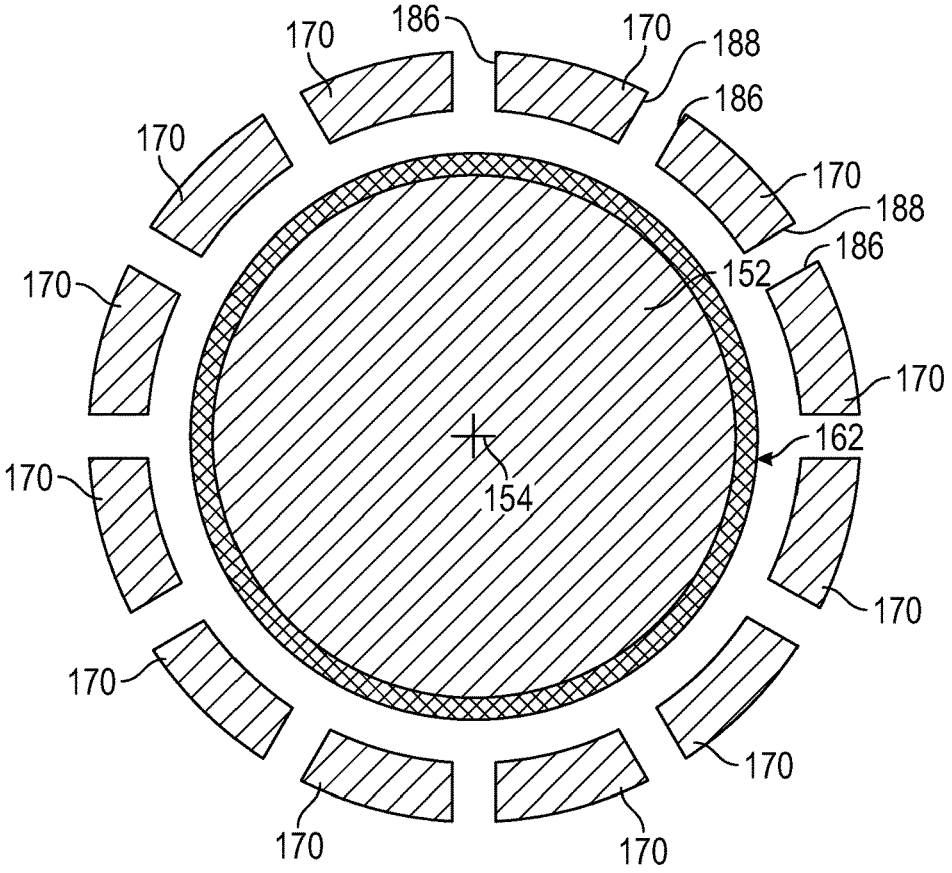
FIG. 9 depicts an end view of a plurality of the outer electrical conductor segments shown in FIG. 8 arranged around the inner electrical conductor element shown in FIG. 7, according to one or more embodiments described.
Figure 10:
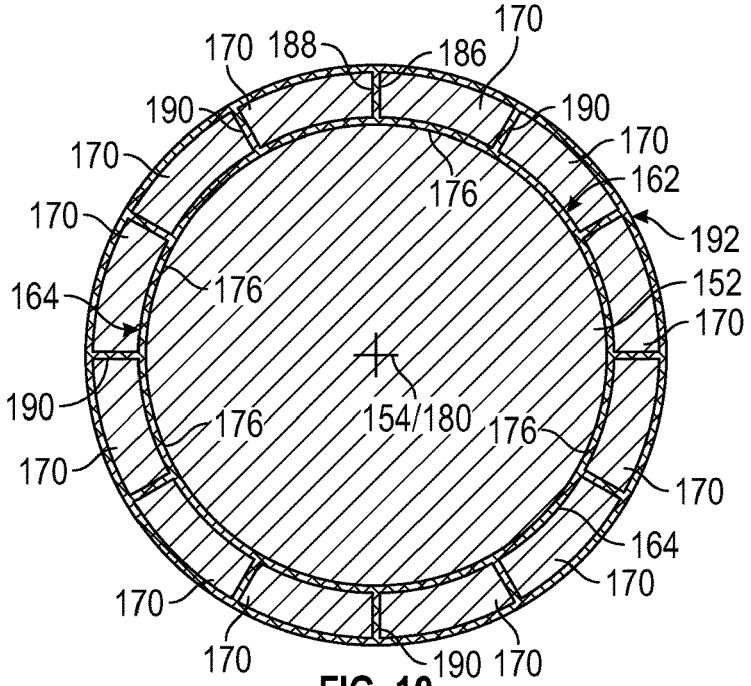
FIG. 10 depicts an end view of the electrical conductor segments shown in FIG. 9 disposed about the polymer jacket of the inner electrical conductor element shown in FIG. 7, according to one or more embodiments described.

FIG. 9 depicts an end view of a plurality of the electrically conductive segments 170 shown in FIG. 8 arranged around the inner electrically conductive element 152 shown in FIG. 6, according to one or more embodiments. The electrically conductive segments 170 (twelve are shown) are shown azimuthally spaced around the inner electrically conductive element 152 and radially spaced apart from the inner electrically conductive element 152. In the configuration shown in FIG. 9, the electrically conductive segments 170 have yet to be assembled into the final arrangement found in conductor 150. FIG. 10 depicts an end view of the electrically conductive segments 170 shown in FIG. 8 disposed about the first polymer jacket 162 of the inner electrically conductive element 152 shown in FIG. 7, according to one or more embodiments. The electrically conductive segments 170, as shown in FIG. 10, have been assembled into the final arrangement found in conductor 150 (FIG. 6). As shown in FIG. 10, the first arc surfaces 176 of the electrically conductive segments 170 can be in contact with an outer surface 164 of the first polymer jacket 162. The electrically conductive segments 170 can be azimuthally spaced from one another such that the radially extending surfaces 186/188 of one electrically conductive segment 170 can be free from contact with the radially extending surfaces 186/188 of the other electrically conductive segments 170. When the electrical conductor 150 is assembled, the segment longitudinal axis 180 (FIG. 8) of the electrically conductive segments 170 can be co-linear with the central longitudinal axis 154 of the inner electrically conductive element 152.

The electrical conductor 150 can include the second polymer jacket 190 that can be positioned between the radially extending surfaces 186/188 of the electrically conductive segments 170. The second polymer jacket 190 can physically separate the electrically conductive segments 170 from one another and can azimuthally space the electrically conductive segments 170 from one another. The second polymer jacket 190 and the electrically conductive segments 170 can define an annular cross-sectional area 192 and an outer perimeter surface 194 along the length of the electrical conductor 150 (FIG. 6). The electrical insulator 196 can be disposed about the outer perimeter surface 194 along the length of the electrical conductor 150, as shown in FIG. 6.

Figure 11:
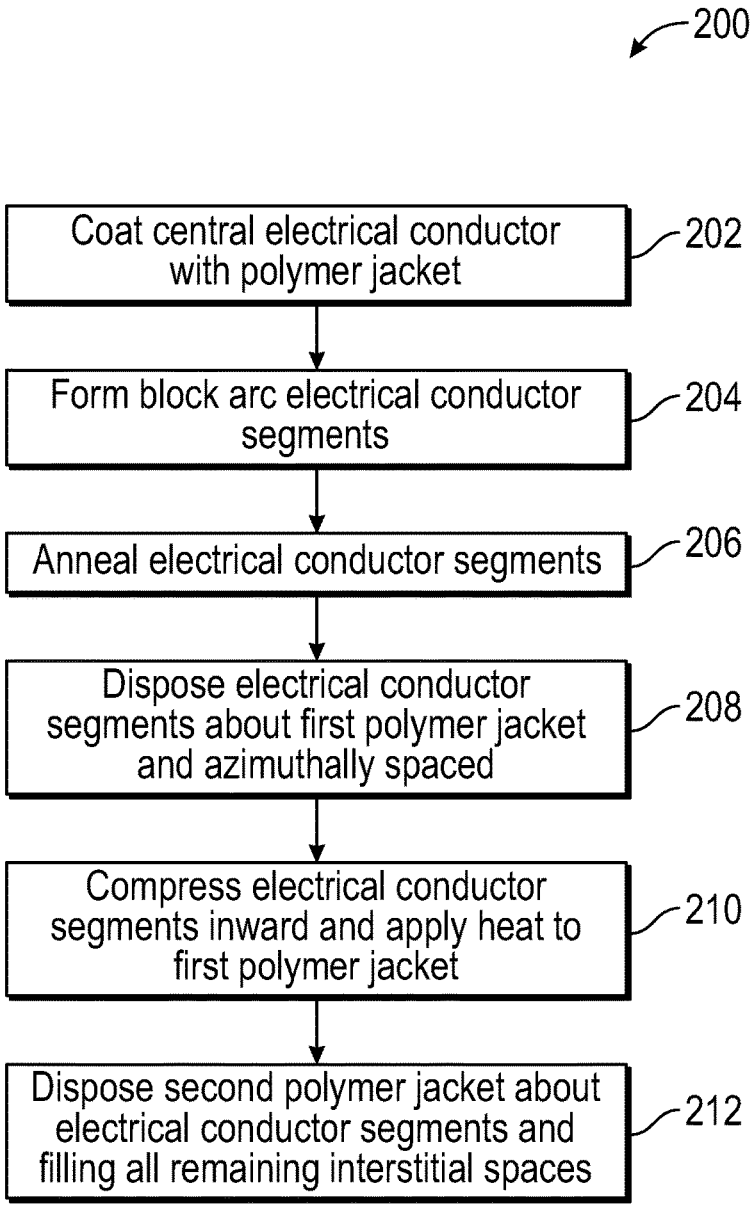
FIG. 11 depicts a flow diagram of a process for making the electrical conductors shown in FIGS. 1 and 6, according to one or more embodiments described.

FIG. 11 depicts a flow diagram of a process 200 for making the electrical conductors 100/150 shown in FIGS. 1 and 6, according to one or more embodiments. The inner electrically conductive element 102/152 can be coated with a first polymer jacket 112/162, as shown in FIGS. 2 and 7 (process block 202). The material of the first polymer jacket 112/162 can be extruded or otherwise applied to the inner electrically conductive element 102/152.

The electrically conductive segments 120/170 can be formed to substantially have the block arc cross-sectional area 122/172, as shown in FIGS. 3 and 8 (process block 204). The electrically conductive segments 120/170 can be formed by rolling, drawing and/or forcing the conductive material through one or more forms and/or dies until the electrically conductive segments 120/170 have taken the block arc shape. The electrical conductor 100/150 can include 2 or more electrically conductive segments 120/170.

The electrically conductive segments 120/170 can be annealed to reduce the hardness and/or increase the ductility of the electrical conductor segments 120/170 (process block 206). Annealing can reduce the electrical resistance of the electrical conductor segments 120/170. The electrically conductive segments 120/170 can be disposed about the first polymer jacket 112/162 and azimuthally spaced from one another, as shown in FIGS. 4 and 9 (process block 208).

The electrically conductive segments 120/170 can be compressed inward toward the central longitudinal axis 104/154 while heat is applied to the first polymer jacket 112/162 (process block 210). The heat can be sufficient to flow the material of the first polymer jacket 112/162 and the heated first polymer jacket material flows at least partially between the electrically conductive segments 120/170 and can embed the electrically conductive segments 120/170 into the first polymer jacket 112/162, as shown in FIGS. 5 and 10.

The second polymer jacket between the electrical conductor segments 120/170 can be referred to as the second polymer jacket 140/190 and can be at least partially composed of material from the first polymer jacket 112/162. The first polymer jacket 112/162 can be applied so that the polymer material can flow in between the electrical conductor segments 120/170 to form the second polymer jacket 112/162 while remaining first polymer material can cover and/or protect the inner electrical conductor 102/152. The electrical conductor segments 120/170 can be compressed inward and the heat can be applied (process block 210) using a heated die and/or a separate heat source. The heat can be applied to the first polymer jacket 112/162 using hot air, radiation (such as infra-red radiation), induction heating, and/or another heating source sufficient to flow, for example, melt the first polymer jacket 112/162.

Compression of the electrically conductive segments 120/170 and heating of the first polymer jacket 112/162 can cause the polymer material to flow around the electrically conductive segments and can substantially eliminate, reduce, and/or eliminate any interstitial spaces from between the separate electrically conductive segments 120/170, and from between the inner electrically conductive element 102/152 and the electrically conductive segments 120/170. Substantially eliminating the interstitial spaces can include reducing the interstitial space, e.g., the cross-sectional area of the conductor that comprises a void or empty space, below at most 5%, at most 2% at most 1%, at most 0.5%, or at most 0.1% of the total cross-sectional area, respectively, of the electrical conductors 100, 150, 220, and/or 260.

An electrical insulator 146/196 can be disposed about the outer perimeter surface 144/194 of the second polymer jacket 140/190 and electrically conductive segments 120/170, as shown in FIGS. 1 and 6, (process block 212). The electrical insulator 146/196 can be extruded or otherwise applied and can seal the electrical conductor 100/150 against external contaminants, e.g., fluids, and can electrically insulate the electrically conductive segments 120/170 to prevent electrical current from flowing from the electrically conductive segments 120/170 outside of the electrical conductors 100/150.

Figure 12:
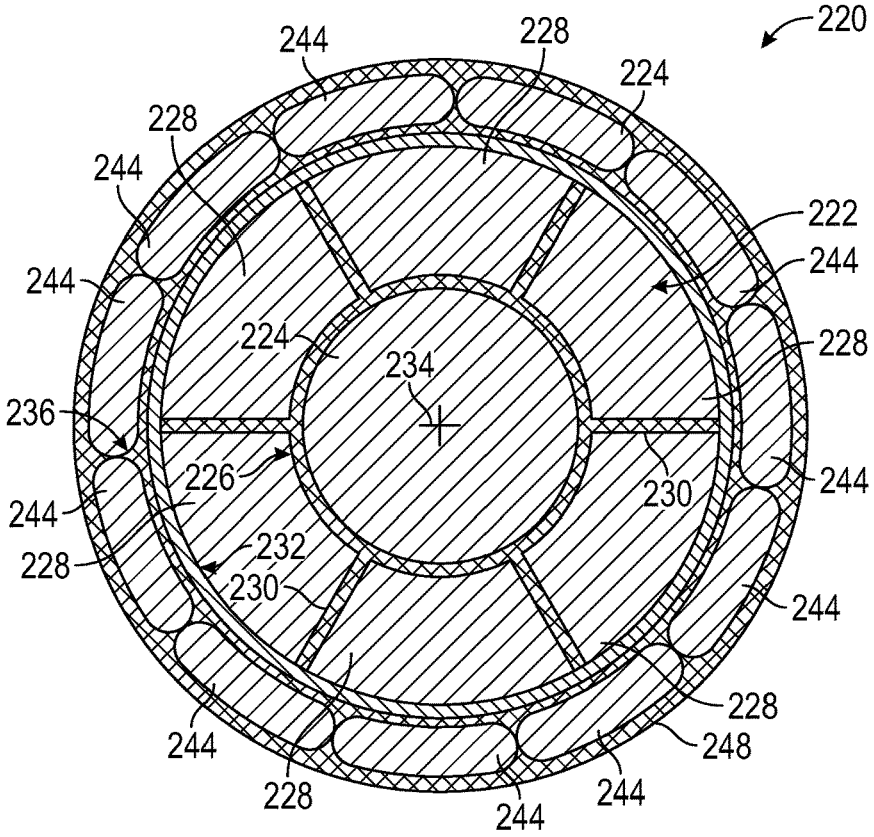
FIG. 12 depicts an end view of another illustrative electrical conductor, according to one or more embodiments described.

FIG. 12 depicts an end view of another illustrative electrical conductor 220, according to one or more embodiments. The electrical conductor 220 can include an inner core 222 that can include an inner electrical conductor 224, a first polymer jacket 226, a plurality of electrically conductive segments 228, a second polymer jacket 230, and an electrical insulator 232. The electrical conductor 220 can define a central longitudinal axis 234. The inner core 222 can be configured similar to the electrical conductors 100/150 shown in FIGS. 1 and 6, and can have more or less electrically conductive segments 228 than shown in FIG. 12. The electrical conductor 220 can include a second electrical insulator 236, a plurality of electrical conductor elements 240, and a third electrical insulator 248.

Figure 13:
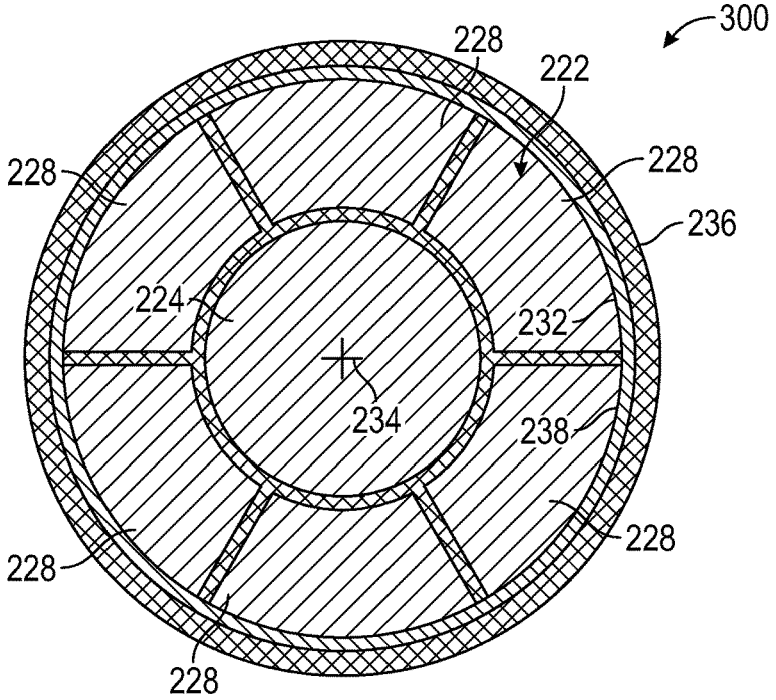
FIG. 13 depicts an end view of the electrical conductor shown in FIG. 1 with an electrical insulator disposed about an outer perimeter of the electrical conductor, according to one or more embodiments described. Note that this electrical insulator 232 shall be chemically bondable with the polymer jacket.

FIG. 13 depicts an end view of the electrical conductor inner core 222 shown in FIG. 12 with the second electrical insulator 236 disposed about an outer perimeter 238 of the inner core 222, making an insulated conductor 300 according to one or more embodiments. The second electrical insulator 236 can be the same material or a different material than the first electrical insulator 232. In one or more examples, the second electrical insulator 236 can have a lower melting point than the first electrical insulator 232.

Figure 14:
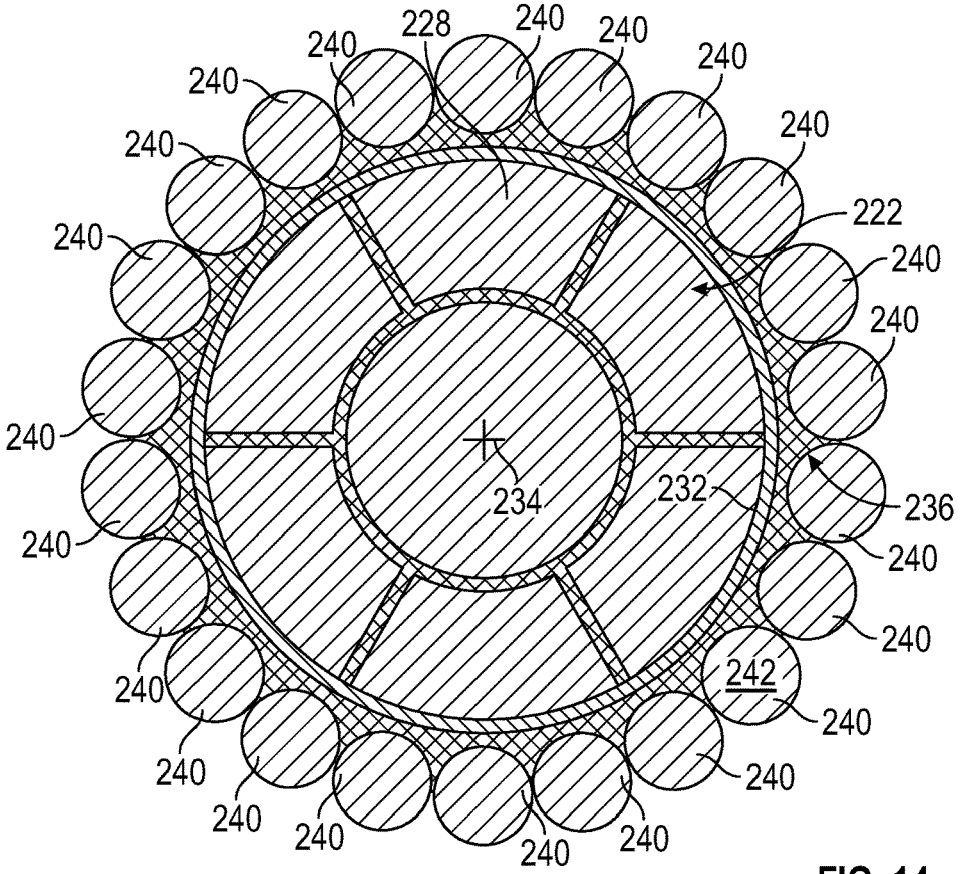
FIG. 14 depicts an end view of the electrical conductor and electrical insulator shown in FIG. 13 with a plurality of circular electrical conductor elements embedded in the electrical insulator, according to one or more embodiments described.

FIG. 14 depicts an end view of the electrical conductor inner core 222 and the second polymer jacket 236 shown in FIG. 13 with the plurality of electrical conductor elements 240 embedded in the second polymer jacket 236, according to one or more embodiments. The electrically conductive elements 240 can be azimuthally spaced around the central longitudinal axis 234 and can be embedded in the second polymer jacket 236. In one or more examples, a cross-sectional area 242 of the electrically conductive elements 240 can each be substantially round and/or can be at least partially elliptically shaped, e.g., at least partially circularly shaped.

Figure 15:
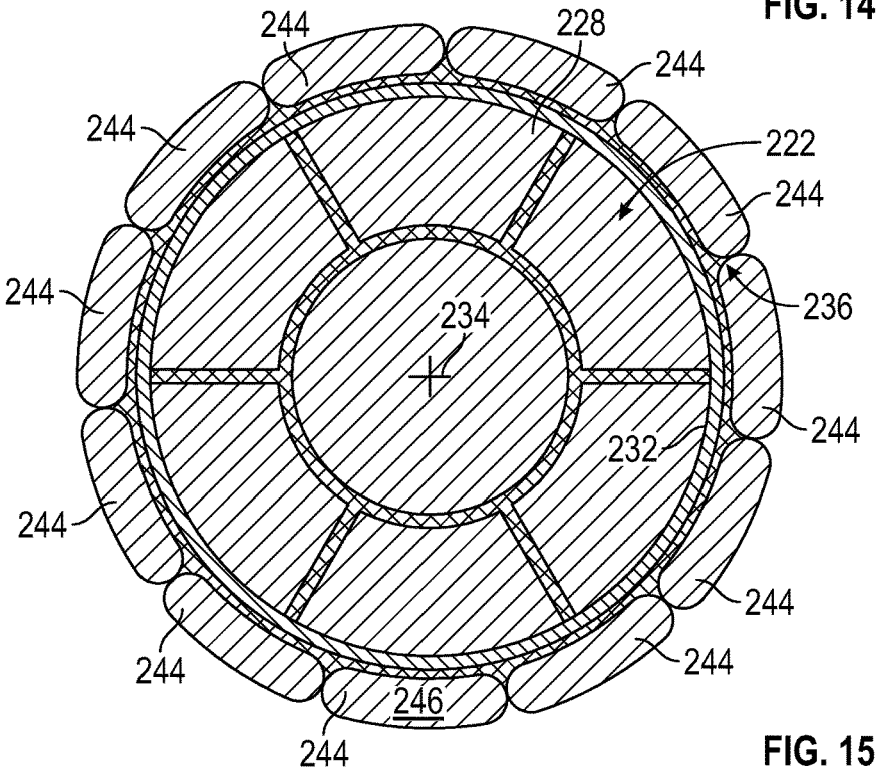
FIG. 15 depicts an end view of the electrical conductor and electrical insulator shown in FIG. 13 with a plurality of electrical conductor elements having another configuration and embedded in the electrical insulator, according to one or more embodiments described.

FIG. 15 depicts an end view of the electrical conductor inner core 222 and second polymer jacket 236 shown in FIG. 13 with a plurality of electrically conductive elements 244 having a cross-sectional area 246 embedded in the second polymer jacket 236, according to one or more embodiments. In one or more examples, the cross-sectional area 246 of the electrically conductive elements 244 can have a substantially rectangular shape. In one or more examples, the cross-sectional area 246 can have a substantially rectangular shape with rounded ends.

In one or more examples, the electrically conductive elements 240/244 can be embedded at least partially, e.g., at least halfway of the thickness of the electrically conductive elements 240/244, into the second electrical insulator 236. In one or more examples, the electrically conductive elements 240 can be embedded in the second polymer jacket 236 by heating the electrically conductive elements 240/244 and/or the second electrical insulator 236 and applying pressure to the electrically conductive elements 240/244 toward the central longitudinal axis 234. The electrical conductor 220 can include the an electrical insulator 248 disposed around the electrically conductive elements 240/244, as shown in FIG. 12. The electrical insulator 248 (FIG. 12) can be extruded or otherwise applied and can seal the electrical conductor 220 against external contaminants and fluids, and can electrically insulate the electrically conductive elements 240/244 to prevent electrical current from flowing from the elements outside of the electrical conductor 220. In one or more examples, the electrical conductor 220 can be used to form a coaxial cable.

Figure 16:
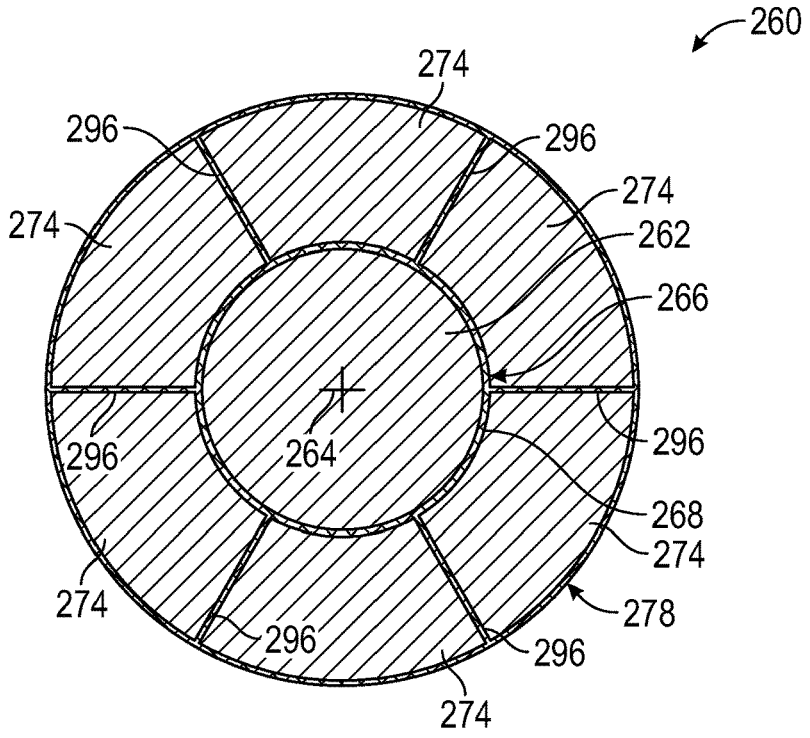
FIG. 16 depicts an end view of another illustrative electrical conductor, according to one or more embodiments described.
Figure 17:
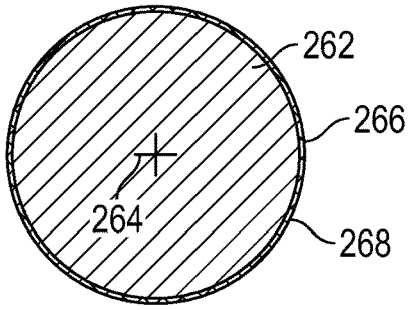
FIG. 17 depicts an end view of an inner electrically conductive element of the electrical conductor shown in FIG. 16, according to one or more embodiments described.

FIG. 16 depicts an end view of another illustrative electrical conductor 260, according to one or more embodiments. The electrical conductor 260 can include an inner electrically conductive element 262 which can define a central longitudinal axis 264. FIG. 17 depicts an end view of the inner electrically conductive element 262 of the electrical conductor 260 shown in FIG. 16, according to one or more embodiments. The electrical conductor 260 can include a first polymer jacket 266, which can coat a surface 268 of the inner electrically conductive element 262. The electrical conductor 260 can include a plurality of electrically conductive segments 274, and a second polymer jacket 296. A third polymer jacket 278 may be extruded over the complete assembly 260 to fill the remaining outer interstitial voids between the segments 274. The third polymer jacket 278 may or may not be electrically insulating.

Figure 18:
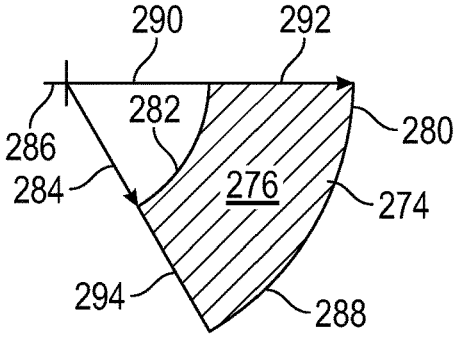
FIG. 18 depicts an end view of a non circular electrical conductor segment of the electrical conductor shown in FIG. 16, according to one or more embodiments described.

FIG. 18 depicts an end view of one of the electrically conductive segments 274 of the electrical conductor 260 shown in FIG. 16, according to one or more embodiments. The electrically conductive segment 274 can have a cross-sectional area 276 that is at least partially block arc shaped. The block arc shaped cross-sectional area 276 of the electrically conductive segment 274 can include a portion of an annular shape such that two or more electrically conductive segments 274 together can at least partially form an annular shaped cross-sectional area 278 (FIG. 16). The electrically conductive segment 274 can have an outer perimeter surface 280 that can include a first arc surface 282, a second arc surface 288, a first radially extending surface 292, and a second radially extending surface 294. The first arc surface 282 can be defined by a first radius 284 extending from a segment longitudinal axis 286, the second arc surface 288 can be defined by a second radius 290 from the segment longitudinal axis 286. The first radially extending surface 292 can extend between the first arc surface 282 and the second arc surface 288, and can extend in a first azimuthal direction relative to the segment longitudinal axis 286. The second radially extending surface 294 can extend between the first arc surface 282 and the second arc surface 288, and can extend in a second azimuthal direction relative to the segment longitudinal axis 286.

Figure 19:
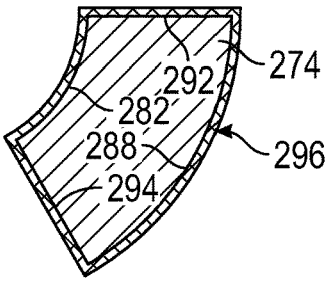
FIG. 19 depicts an end view of the non circular electrical conductor segment shown in FIG. 18 with a polymer jacket, according to one or more embodiments described.

FIG. 19 depicts an end view of the electrically conductive segment 274 shown in FIG. 18 with a second polymer jacket 296, according to one or more embodiments. The electrically conductive segments 274 can be individually coated with the second polymer jacket 296. The coating can be applied by extruding the material of the second polymer jacket 296 over the electrically conductive segments 274, and/or by another process for coating a conductor with an insulator. The second polymer jacket 296 can be coated on the first arc surface 282, the second arc surface 288, the first radially extending surface 292 and the second radially extending surface 294 and each surface 282, 288, 292 and 294 can have the same and/or different thicknesses of the second polymer jacket 296 and the same and/or different types of polymeric material.

In one or more examples, as shown in FIG. 16, the coated electrically conductive segments 274 can be azimuthally spaced about the coated inner electrically conductive element 262 to form the completed electrical conductor 260. In one or more examples, the electrically conductive segments 274 can be spaced about the inner electrically conductive element 262 such that the segment longitudinal axis 286 is co-linear with the central longitudinal axis 264 of the inner electrically conductive element. In one or more examples, the first polymer jacket 266 and the second electrical polymer jacket 296 can be heated until melted together. In one or more examples, the electrically conductive segments 274 can be compressed inward toward the central longitudinal axis 264 and/or heat may be applied to partially or fully close any interstitial space.

In one or more examples, the electrical conductors 100, 150, 220, and/or 260 can be completely fluid blocked by the combination of electrical conductive strands polymeric jackets, and electrical insulators. The fluid blocking can eliminate any interstitial volumes in the conductors which can reduce or eliminate coronas that can form in interstitial volumes when the electrical conductors carry high electrical potentials. Reducing or eliminating coronas can increase the efficiency of the electrical conductor by increasing the life of the polymer materials.

In one or more examples, at least 80%, at least 80.5%, at least 81%, at least 81.5%, at least 82%, at least 82.5%, at least 83%, at least 83.5%, at least 84%, at least 84.5%, at least 85%, at least 85.5%, at least 86%, at least 86.5%, at least 87%, at least 87.5%, at least 88%, at least 88.5%, at least 89%, at least 89.5%, at least 90%, at least 90.5%, at least 91%, or at least 91.5%, or at least 92%, or at least 92.5%, or at least 93%, or at least 93.5%, or at least 94%, or at least 94.5%, or at least 95%, or at least 95.5%, or at least 96%, or at least 96.5%, or at least 97%, or at least 97.5% or more of the total cross-sectional area of the electrical conductor 100, 150, 220, and/or 260 can be configured to carry current. In some examples, at least 80% to about 82%, at least 82% to about 84%, at least 84% to about 86%, at least 86% to about 88%, at least 88% to about 90%, at least 90% to about 92%, at least 92% to about 94%, at least 94% to about 96%, or at least 96% to about 98% of the total cross-sectional area of the electrical conductors 100 and 150 can be configured to carry electrical current.

In some examples, the electrical conductors can increase the percentage of the cross-sectional area used for carrying current by at least 1%, at least 3%, at least 5%, at least 7%, at least 9%, at least 11%, at least 13%, at least 15%, at least 17%, at least 19% or at least 20% over a multiple round stranded cable of a similar cross-sectional area. The electrical cables utilizing electrical conductor described herein can have an increase in the percentage of the cross-sectional area capable of carrying current as compared to a multiple round stranded cable having the same cross-sectional area, but made in a conventional manner. In some examples, the percentage of the cross-sectional area in the electrical cables can be increased by at least 4%, at least 5%, at least 6%, at least 7%, at least 8%, at least 9%, at least 10%, at least 11%, at least 12%, at least 13%, at least 14%, at least 15%, at least 16%, at least 17%, at least 18%, at least 19%, or at least 20% or more as compared to a multiple round stranded cable having the same cross-sectional area, but made in a conventional manner.

The electrical inner electrically conductive elements and/or electrically conductive segments 102, 120, 152, 170, 224, 228, 240, and/or 244 can each be or include, but is not limited to, a metal, an electrically conductive polymer, or a combination thereof. In some examples, the electrical inner electrically conductive elements and/or electrically conductive segments 102, 120, 152, 170, 224, 228, 240, and/or 244 can be or include, but is not limited to, copper, aluminum, silver, gold, tin, lead, zinc, phosphorus, alloys thereof, or any combination thereof. In other examples, the electrical inner electrically conductive elements and/or electrically conductive segments 102, 120, 152, 170, 224, 228, 240, and/or 244 can be or include copper, aluminum, copper-clad aluminum, silver-clad aluminum, silver-clad copper, steel, or phosphor bronze. In some examples, the electrical inner electrically conductive elements and/or electrically conductive segments 102, 120, 152, 170, 224, 228, 240, and/or 244 can be or include, but is not limited to, electrically conducting polymers or co-polymers such as polyacetylene (PA), polypyrrole (PPY), poly (phenylacetylene) (PPA), poly (p-phenylene sulphide) (PPS), poly (p-phenylene) (PPP), polythiophene (PTP), polyfuran (PFU), polyaniline (PAN), polyisothianaphthene (PIN), fluorinated polyacetylenes, halogen and cyano substituted polyacetylenes, alkoxy-substituted poly (p-phenylenevinylene), poly (5,6-dithiooctyl isothianaphthene, anilne copolymers containing butylthio substituent, butylthioaniline copolymers, cyano-substituted distyryl benzenes, poly (fluorenebenzothiadiazsole-cyanophenylenevinylene), other polymers and/or co-polymers, or any combination thereof. In some examples, the electrical inner electrically conductive elements and/or electrically conductive segments 102, 120, 152, 170, 224, 228, 240, and/or 244 can be a solid or single body, e.g., a single metallic wire. In other examples, the electrical inner electrically conductive elements and/or electrically conductive segments 102, 120, 152, 170, 224, 228, 240, and/or 244 can be composed of a plurality of bodies, e.g., a plurality of metallic wires or a plurality of electrically conductive polymer fibers.

Each, or any combination, of the polymer jackets or coatings 112, 140, 146, 162, 190, 196, 226, 230, 232, 236, 248, 266, 296 can be or include, but is not limited to, one or more thermoset polymers, one or more thermoplastic polymers, paper, fiberglass, or combinations thereof. In some examples, the polymer materials 112, 140, 146, 162, 190, 196, 226, 230, 232, 236, 248, 266, 296 can each be or include, but is not limited to, polyethylene, polyurethane, rubber, crosslinked polyethylene, polyvinyl chloride, polytetrafluoroethylene, ethylene tetrafluoroethylene, tetrafluoroethylene, fluorinated ethylene propylene, a polyimide, oil impregnated paper, modified ethylene tetrafluoroethylene, cresyl phthalate, wax, polyetherketone (PEK), polyether ether ketone (PEEK), polyaryletherketone (PAEK), or any combination thereof. Illustrative rubber can be or include, but is not limited to, thermoplastic rubber, neoprene (polychloroprene), styrene butadiene rubber (SBR), silicone, natural rubber, ethylene propylene diene monomer (EPDM), ethylene propylene rubber (EPR), chlorosulfonated polyethylene (CSPE), other thermoset rubber, any other type of rubber, or any combination thereof. In some examples, the electrical insulators 112, 140, 146, 162, 190, 196, 226, 230, 232, 236, 248, 266, 296 can be selected based at least in part on material, insulating capacity, thickness, cost, meltability, heat tolerance, melting temperature, temperature capacity, stability and/or other properties. The polymer materials used to fill the interstitial spaces of the conductor designs described here may or may not be conductive. In an embodiment the polymer jackets can be chemically compatible with the electrically insulating layers used so that these materials may be bonded together and no small void spaces remain through which gases or other fluids can wick or flow.

In some examples, the electrical conductors 100, 150, 220, and/or 260 can be connected to a wellbore tool, not shown, and can provide electrical power to the tool or can serve as an umbilical. In some examples, the inner electrically conductive elements 102, 152, 224, and/or 262 of the electrical conductors 100, 150, 220, and/or 260 can be electrically connected to the wellbore tool such that an electric current can flow from the electrical cable to the wellbore tool. In other examples, the electrically conductive segments 120, 170, 228, and/or 274 of the electrical conductors 100, 150, 220, and/or 260 can be electrically connected to the wellbore tool such that an electric current can flow from the electrical cable to the wellbore tool. In other examples, the electrically conductive elements 240 and/or 244 of the electrical conductors 100, 150, 220, and/or 260 can be electrically connected to the wellbore tool such that an electric current can flow from the electrical cable to the wellbore tool. In other examples, any one or more of the electrical inner electrically conductive elements and/or electrically conductive segments, i.e., 102, 152, 224, and 262, 120, 170, 228, 274, 240, and/or 244, of the electrical conductors can be electrically connected to the wellbore tool such that the cable can electrically ground the wellbore tool, provide power to the wellbore tool, and/or provide electrical communication signals to and/or from the wellbore tool. In other examples, the number, size, and/or material of the inner electrically conductive elements 102, 152, 224 and/or 262, electrically conductive segments 120, 170, 228, and/or 274, and/or electrical conductor elements 240 and/or 244 that can be included in the electrical conductors can depend, at least in part, on the electrical demand of a given wellbore tool.

In some examples, the wellbore tool can include one or more electric submersible pumps, one or more seismic imager tools, one or more motors, one or more well logging tools, or any other downhole instrument that may be electrically powered.

In some examples, the electrical conductors and cables made using the conductors can be used as an oceanographic cable. In other examples, the electrical conductors and cables made using the conductors can be used in sub-sea applications, such as for remotely operated vehicles, diving bell umbilical cables, well head control cable, and/or other underwater cable. In other examples, the electrical conductors and cables made using the conductors can be used in applications using low electrical resistance and small size.

Embodiments of the present disclosure further relate to any one or more of the following paragraphs:

1. An electrical conductor, comprising: an inner electrically conductive element defining a central longitudinal axis, and a first polymer jacket disposed circumferentially about the inner electrically conductive element, and a plurality of electrically conductive segments disposed about the first polymer jacket and spaced around the central longitudinal axis, and a second electrical insulator disposed between the electrically conductive segments, and wherein the second polymer jacket and the electrically conductive segments together define a substantially annular cross-sectional area and an outer perimeter surface, and an electrical insulator disposed about the outer perimeter surface defined by the second electrical insulator and the electrical conductor segments.

Although the preceding description has been described herein with reference to particular means, materials, and embodiments, it is not intended to be limited to the particulars disclosed herein; rather, it extends to all functionally equivalent structures, processes, and uses, such as are within the scope of the appended claims.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim is not defined above, it should be given the broadest definition persons in the pertinent art have given that term as reflected in at least one printed publication or issued patent. Furthermore, all patents, test procedures, and other documents cited in this application are fully incorporated by reference to the extent such disclosure is not inconsistent with this application and for all jurisdictions in which such incorporation is permitted.

While the foregoing is directed to embodiments of the present invention, other and further embodiments of the invention may be devised without departing from the basic scope thereof, and the scope thereof is determined by the claims that follow.

What is claimed is:

1. An electrical conductor, comprising:

an inner electrically conductive element defining a central longitudinal axis;

a first polymer layer disposed circumferentially about the inner electrically conductive element;

a plurality of electrical conductor segments disposed about the first polymer layer and spaced around the central longitudinal axis;

a second polymer layer disposed between the electrical conductor segments, wherein the second polymer layer and the electrical conductor segments together define an annular cross-sectional area and an outer perimeter surface;

an electrical insulator disposed about the outer perimeter surface defined by the second polymer and the electrical conductor segments;

an additional electrical insulator disposed about the electrical insulator; and a plurality of electrically conductive elements embedded in the additional electrical insulator and azimuthally spaced around the central longitudinal axis.

2. The electrical conductor of claim 1, wherein the first polymer layer and the second polymer layer are composed of the same polymer material.

3. The electrical conductor of claim 1, wherein the first polymer layer, the second polymer layer, and the electrical insulator are composed of the same electrically insulating material.

4. The electrical conductor of claim 1, wherein the first polymer layer, the second polymer layer, the electrical insulator, the electrical conductor segments, and the second electrical insulator essentially completely fill a volume inside the electrical insulator.

5. The electrical conductor of claim 1, wherein there are at least six electrical conductor segments.

6. The electrical conductor of claim 1, wherein there are at least twelve electrical conductor segments.

7. The electrical conductor of claim 1, wherein the second polymer layer extends radially away from the central longitudinal axis.

8. The electrical conductor of claim 1, wherein each of the electrical conductor segments defines a block arc cross-sectional area.

9. The electrical conductor of claim 1, wherein the cross-sectional area of the electrically conductive elements has a rectangular geometry.

10. The electrical conductor of claim 1, further comprising:

an additional electrical insulator disposed around the electrically conductive elements.

11. The electrical conductor of claim 1, wherein at least 80% of a total cross-sectional area of the electrical conductor is configured to carry current.

* * * * *